US006430258B1

(12) United States Patent
Spaak

(10) Patent No.: US 6,430,258 B1
(45) Date of Patent: Aug. 6, 2002

(54) METHOD FOR OPERATING A RADIATION EXAMINATION DEVICE

(75) Inventor: Willem Eelke Spaak, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/817,975

(22) Filed: Mar. 27, 2001

(30) Foreign Application Priority Data

Mar. 31, 2000 (EP) ..... 00106880

(51) Int. Cl.[7] ..... H05G 1/64
(52) U.S. Cl. ..... 378/98.7; 378/95
(58) Field of Search ..... 378/98.7, 108, 378/95, 97

(56) References Cited

U.S. PATENT DOCUMENTS 5,194,736 A * 3/1993 Meulenbrugge et al. ..... 250/370.07
5,388,138 A * 2/1995 Fujiwara ..... 378/108
5,574,764 A * 11/1996 Granfors et al. ..... 378/98.7
5,710,801 A * 1/1998 Dillen et al. ..... 378/98.7
6,175,614 B1 * 1/2001 Jensen et al. ..... 378/98.7

* cited by examiner

*Primary Examiner*—Robert H. Kim
*Assistant Examiner*—Jurie Yun
(74) *Attorney, Agent, or Firm*—John Vodopia

(57) ABSTRACT

The invention relates to a method for operating a radiation examination apparatus, especially an X-ray apparatus, that includes a radiation source and a detector device. The invention proposes the use of a control signal for "during pulse" radiation control, being a combination of a dose or a dose rate signal, measured by a dose rate measuring device, and an adaptive control value that is obtained, using an adaptive control algorithm, from the mean image working points within a selected region of interest of every individual preceding image within an image sequence. A detector device and a radiation examination apparatus are also claimed.

20 Claims, 1 Drawing Sheet

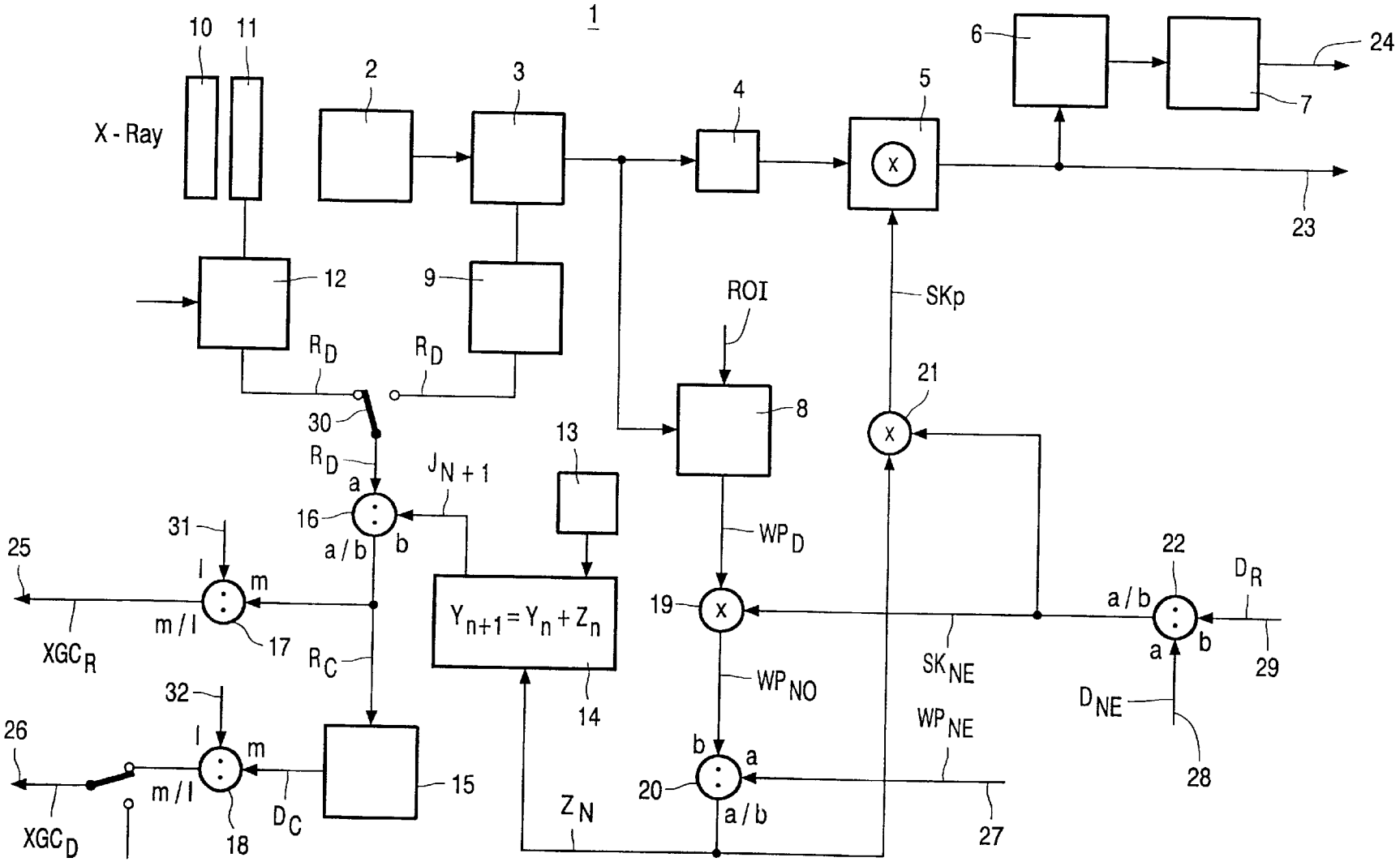
X - Ray
ROI
SKp
$D_R$
$D_{NE}$
$SK_{NE}$
$WP_{NE}$
$WP_D$
$WP_{NO}$
$Z_N$
$J_{N+1}$
$R_D$
$R_C$
$D_C$
$Y_{n+1} = Y_n + Z_n$
a / b
m / l
$XGC_R$
$XGC_D$

METHOD FOR OPERATING A RADIATION EXAMINATION DEVICE

BACKGROUND OF THE INVENTION

1. Field of the Invention

The invention relates to a method for operating a radiation examination device, in particular an X-ray-examination device, which includes a radiation source and a detector device for the acquisition of radiation images, the imaging dose and/or dose rate that is incident on a detector of the detector device being measured and a control valve for controlling the radiation source being determined while using said measured dose and/or dose rate. The invention also relates to a corresponding detector device as well as to a radiation examination device with a radiation source and a corresponding detector device for carrying out the method.

2. Description of Related Art

For operation of such radiation examination devices it is desirable that the imaging dose or dose rate that is incident on the detector during the irradiation is known as exactly as possible so as to enable the radiation source to be controlled in such a manner that an optimum amount of radiation for the relevant examination is emitted by the radiation source. This is important notably for medical radiation examination devices such as, for example X-ray diagnostic devices. The patient to be examined therein should be exposed to the minimum necessary X-ray dose only.

In the context of the present application the terms "radiation source" and "X-ray source" are to be understood to means the entire equipment emitting radiation used for the examination. The terms "dose" and "dose rate" are to be understood to mean the input dose or dose rate incident on the detector behind the object to be examined, for example the patient.

The measurement of the incident radiation during a radiation pulse is problematic notably when use is made of flat dynamic X-ray detectors (Dynamic Flat Panel X-ray Detectors). The information concerning the X-rays incident during an image can customarily be derived only from a preceding image, unless additional devices are used for measuring the dose or dose rate in an "on-line" fashion (that is, during the X-ray pulse).

For example, U.S. Pat. No. 5,194,736 discloses an X-ray examination apparatus which includes a sensor matrix where the residual currents occurring because of stray capacitances around the switching transistor of the relevant matrix element are used to measure the radiation dose. This measurement can be performed at option via the read-out line, utilizing signal amplifiers that are present any way, or via special amplifiers in the counter electrode. At least the radiation duration or the radiation intensity is controlled by means of a control unit in dependence on the radiation measurement thus performed. This method has a drawback in that the measuring zone is fixed in a sense that either complete columns of the detector matrix or predetermined, specially wired regions must be read out, because for reasons of cost it would not be efficient to associate a respective amplifier with each individual sensor element. Such measuring zones, however, usually do not correspond exactly to the relevant region of interest (ROI) during the respective examination.

Generally speaking, the term ROI is used to indicate the region within the image that is of special interest to the relevant examination. For example, in the case of an X-ray examination of a patient this is the image region in which the relevant organ to be examined is reproduced.

Also known are methods in which an ionization chamber is arranged in front of the detector itself, which ionization chamber is used to measure the dose rate. This does not offer an optimum possibility either for taking into account the specific ROI during the measurement, because the ionization chamber limits the ROI functionality.

SUMMARY OF THE INVENTION

It is an object of the present invention to provide an improved method of the kind set forth and corresponding devices for carrying out this method, enabling a simple, economical and effective control of the radiation source such that each individual image is formed as exactly as possible while utilizing the optimum radiation dose for the selected ROI, This object is achieved by a method of the kind set forth which is characterized in that for each image of a measuring sequence of successive images acquired by the detector device an image correction value is determined in dependence on a selected image region of the detector device and an adaptive correction value is determined while using said image correction value and the image correction values of the preceding images in the measuring sequence, the control value for controlling the radiation source being derived from the measured dose and/or dose rate while utilizing said adaptive correction value.

The additional adaptive correction value compensates the measuring errors of the device for measuring the dose or the dose power to a high degree; the dependency on a selected image region thus enables the ROI to be taken into account for the correction so that the ROI is taken up in the control value for controlling the radiation source. Because of the adaptive method, all image correction values of all preceding images are used within a measuring sequence. Compensation is thus made for the fact that the image correction value can be determined only after the formation of an image and hence becomes available for subsequent images only, so that it is not possible to determine the image correction value during the irradiation for direct control of the radiation source. Furthermore, compensation takes place in that the adaptive correction value is combined with the instantaneously measured dose or dose rate.

The method is particularly suitable for use in conjunction with dynamic flat panel X-ray detectors in which it is necessary to utilize said special devices for determining the dose or the dose rate. The invention, however, can also be used in principle in any other detector such as Static Flat Panel X-ray Detectors or imaging systems based on image intensifiers/TV chains in which, for example, information concerning the radiation intensity can be acquired via the photosensor during the X-ray exposure.

In a particularly advantageous embodiment for each image acquired first a working point of the detector device is determined from the ratio of a mean image output signal within the selected image region to a maximum image output signal of the detector device. This image working point of the ROI is indicated in relation to the maximum image output signal value. The image correction value is determined while utilizing said working point.

The ratio of the working point to the dose incident on the entrance face of the detector is determined by the so-called transfer function of the detector device. This ratio of working point to incident dose is also dependent on the spectrum because of the spectral dependency of the detector system. During a calibration procedure, carried out by means of a defined calibration radiation spectrum, therefore, the dose value is determined for a so-called "nominal working point". This calibration dose value is the so-called "dose nominal value", that is, for this dose nominal value the nominal working point is obtained automatically on the detector, or within the ROI of the detector, during an exposure in conformity with the calibration spectrum. When real objects, or patients, to be examined are present in the path of the X-ray beam, however, it is to be assumed that the X-ray spectrum incident on the detector deviates from said special calibration spectrum and that, consequently, the dose actually incident on the detector deviates from the dose determined by means of the working point derived from the image.

Preferably, the working point determined for the relevant image is first multiplied by a nominal scaling factor in order to form a normalized working point. This nominal scaling factor is formed by the quotient of the nominal dose value and a selected dose value, that is, a dose value adjusted by the operating staff. Subsequently, the quotient of a nominal working point value and the normalized working point is formed in order to obtain the image correction value. It is thus ensured that ultimately the image correction value represents the deviation between the working point at the adjusted dose from the working point determined from the image.

Because the detector working point, determined by the transfer function, is proportional to the dose incident on the detector as described above, the image must be scaled to the nominal working point for further processing, that is, each time independently of the incident dose, the image correction value is preferably taken into account for the scaling of these images. To this end, the nominal scaling factor is multiplied by the image correction value in a multiplication device, so that overall the image is always scaled to the nominal working point, that is, independently of the adjusted or selected dose value.

Such scaling of the image can be performed either in such a manner that each time the image correction value of the preceding image is used for the scaling of an image. To this end, the image correction value can be filtered by means of a low-pass filter so as to smooth brief fluctuations of the detector working point that are due, for example, to the respiration or the heart beat of the patient. This approach can be used only in the case of comparatively high image rates where the preceding image is representative of the next image.

However, each image is preferably scaled while taking into account the own image correction value. To this end, for example, the image can first be stored in a buffer memory until the detector device has determined the working point and the image correction value for the relevant image, so that it can be used for the further scaling.

The adaptive correction value for a next image is derived preferably from the respective product of the preceding adaptive correction value and the image correction value of the instantaneous image by means of a recursive method. To this end, the device for determining the adaptive correction value includes a correction value buffer memory. The adaptive correction value is each time stored in said correction value buffer memory and is extracted therefrom for the determination of the next correction value. Thus, according to this recursive method the image correction values of all preceding images are quasi multiplied. This means that the system is capable of learning in a sense that the correction value contains each time the entire history of the preceding correction values.

For example, an adaptive correction value from a suitable preceding measuring sequence can be taken as the starting value for such recursive determination of the adaptive correction value. Alternatively, of course special starting value can also be generated by way of a single image acquisition, for example at a low dose, or the starting value is set, for example, simply to the value 1.

Preferably, the adaptive correction value is used to correct the measured dose or dose rate and such a corrected dose or dose rate is subsequently used for determining the control value for controlling the radiation source, for example, by controlling the radiation intensity and/or the exposure time per image.

The method in accordance with the invention ensures correct exposure of each image while taking into account the ROI. The various imperfections of the sensors or the methods for measuring the dose power on the entrance surface of the detector, for example, the spectral deviation between the ionization chamber and the detector, the deviation between the ionization chamber area and the ROI, as well as environmental effects on the measuring results of the ionization chamber, or other errors, are compensated to a high degree. In as far as two successive images are identical, 100% correction is even possible. It can thus be achieved that the dose is optimized as well as possible, during the examination, thus optimizing also the radiation load for the patient in the medical field.

Further details and advantages of the invention will become apparent from the dependent claims and the following description which further illustrates the embodiment of the invention that is shown in the Figure.

BRIEF DESCRIPTION OF THE DRAWINGS

The sole figure is a block diagram of a detector device for carrying out the method in accordance with the invention.

DETAILED DESCRIPTION OF THE PREFERRED EMBODIMENT

The present embodiment is a Dynamic Flat Panel X-ray Detector system. However, it is to be noted again that the invention can also be used in principle for other detector systems.

The detector device 1 includes first of all a detector 2, in this case being a sensor matrix of a Dynamic Flat Panel X-ray Detector. The detector 2 is exposed to X-rays in order to form an image. Subsequently, reading out takes place via the preprocessing unit 3 in which given faults of the detector 2 are already corrected. The working point $WP_D$ of the relevant image can be determined in the device 8 from the image provided by the preprocessing unit 3.

To this end, the respective region of interest (ROI) is input into the device 8. The working point $WP_D$ of the image is determined each time within the ROI. This means that the ratio of the mean image output signal within the ROI to the maximum image output signal is determined.

In the multiplier 19 first the normalized working point $WP_{NO}$ is produced from the image working point $WP_D$ by multiplying the image working point $WP_D$ by a nominal scaling factor $SK_{NE}$. The nominal scaling factor $SK_{NE}$ consists of the output signal of the dividing device 22 and is formed as the quotient of a dose nominal value $D_{NE}$ and a selected dose value $D_R$. The dose nominal value $D_{NE}$ can be applied to the dividing device 22 via the input 28. The selected or adjusted dose value $D_R$ is applied to the dividing device 22 via the input 29.

The normalized working point $WP_{NO}$ of the relevant image that is present at the output of the multiplier device 19 is then applied to a dividing device 20 which forms the quotient of a nominal working point $WP_{NE}$, applied to the dividing device via the input 27, and the normalized working point $WP_{NO}$. This quotient constitutes the desired image correction value $z_n$ of the relevant image. It corresponds essentially to the quotient of the working point for the respective adjusted or selected dose $D_R$ and the working point $WP_D$ determined by means of the device 8.

It is to be noted, however, that the nominal working point $WP_{NE}$ is independent of the dose occurring on the detector. To this end, the dose nominal value $D_{NE}$ has been defined in advance during a calibration procedure involving a specially defined calibration X-ray spectrum, so that the nominal working point $WP_{NE}$ occurs exactly for this dose nominal value $D_{NE}$ on the detector.

The multiplication device 21 determines a scaling factor $SK_p$ for each individual image from the image correction value $z_n$ and the nominal scaling factor $SK_{NE}$. The scaling factor $SK_p$ is used to scale the image in the scaling device 5 to the nominal working point $WP_{NE}$ that is independent of the relevant incident dose. In order to realize such forward coupling, each image subsequent to the preprocessing unit 3 is first stored in a buffer memory 4 so that first the image correction value $z_n$ of the relevant image can be determined and used so as to form the necessary scaling factor $SK_p$.

According to an alternative method (not shown), the image is not stored in a buffer memory 4 but the correction value of the preceding image is used instead. However, it makes more sense to apply this correction value first to a low-pass filter preceding the multiplication device 21 for forming the scaling factor $SK_p$, thus smoothing fast variations that are due, for example, to the respiration or the heart beat of the patient in successive images.

The first of said two methods, however, offers special advantages in the case of a comparatively low image rate where the information of the successive images may deviate too much and an additional delay is not of major importance.

The image delivered by the scaling device can then be applied, via the output 23, directly to a further processing unit and/or be output via the output 24 succeeding a dynamic range converter 6 and a subsequent scale adapter 7.

The correction value $z_n$ for the relevant image is applied to a device 14 which generates an adaptive correction value $y_{n+1}$ for the next image by means of a recursive method. To this end, the ingoing value $z_z$ is multiplied each time by the instantaneous adaptive correction value $y_n$. The device 14 is connected to a buffer memory 13 for this purpose, this memory buffers the instantaneous adaptive correction value $y_n$ each time between two images. The adaptive correction value $y_{n+1}$ emanating from the device 14 for the next image is then used to control the radiation source (not shown) that emits the radiation for forming the images.

In order to control the radiation source as accurately as possible in dependence on the incident dose or dose rate already during the formation of an image, the radiation dose incident on the detector 2 can be measured. To this end, an ionization chamber 11 is arranged directly in front of the detector 2, viewed in the radiation direction. The ionization chamber 11 is preceded by a grid 10 which eliminates scattered radiation from the object from the X-ray beam. The device 12 controls the ionization chamber 11, that is, the necessary voltage is applied thereto and the dose rate $R_D$ is measured and possibly first corrections are already carried out, for example, to compensate environmental effects or deviations in the spectral dependency between the ionization chamber 11 and the detector 2. It is to be noted that such spectral deviations are influenced notably by the applied voltage value and the absorption of the object to be examined, for example, the relevant patient, and hence are liable to vary greatly.

The embodiment shown in the Figure has a second possibility for measuring the dose rate $R_D$ during the irradiation. To this end, the incident dose rate $R_D$ is determined, via the device 9 and the preprocessing unit 3, on the basis of the residual currents occurring due to the stray capacitances in the detector 2. The switch 30 enables switching over from one detection method to the other. It may also be, of course, that the device in accordance with the invention includes only one of the devices for measuring the dose rate. In that case a switch can also be dispensed with.

The dose rate $R_D$ thus determined is applied to the dividing device 16. The dividing device 16 forms the quotient of the measured dose rate $R_D$ and the adaptive correction value $y_{n+1}$ supplied by the device 14. The output value of the dividing device 16 constitutes a corrected dose rate $R_C$. The corrected dose rate $R_C$ thus corresponds to the instantaneous dose rate $R_D$ that has been measured for the relevant image and hence has been corrected while taking into account all preceding image correction values $Z_n$ for which the working point within the ROI has been used.

The corrected dose rate $R_C$ is then applied first to a further dividing device 17 which forms the quotient of the corrected dose rate $R_C$ and an adjusted dose rate that is applied to the dividing device 17 via the input 31. The desired correction value $XGC_R$ for the dose rate is present on the output of the dividing device 17 so as to be applied to the radiation source via the output 25.

Alternatively, the corrected dose rate $R_C$ is applied to a dose rate integrator 15 which determines (on the basis of the corrected dose rate $R_C$), the corrected dose $D_C$ by integration over time. The dividing device 18 forms the quotient of the corrected dose $D_C$ and the adjusted dose that is applied to the dividing device 18 via the input 32. The output of the dividing device 18 then carries the correction value $XGC_D$ for the dose that can be applied to the radiation source via the output 26.

The control by means of the control values $XGC_D$, $XGC_R$ is performed in such a manner that in the case of a control value $XGC_D$, $XGC_R$ greater than 1 the radiation source, that is, the X-ray generator, reduces the dose or the dose rate, whereas the dose or the dose rate is increased in the case of a value smaller than 1. The control thus acts to make the dose rate $R_D$, measured on the detector, or the dose resulting therefrom, correspond to the adjusted dose rate or dose on the one hand and on the other hand to make the adaptive correction value $Y_{n+1}$, and hence the image correction values $z_n$ of the individual images that are multiplicatively present in this value, correspond each time to a value amounting to 1.

An image correction value $z_n$ amounting to 1, however, is present exactly when the detector working point $WP_D$, determined in the ROI by means of the device 8, corresponds exactly to the working point for the selected or adjusted dose $D_R$. This is the case exactly when the incident dose within the ROI corresponds to the adjusted dose $D_R$ and the scaled image has the nominal working point $WP_{NE}$. Consequently, the adaptive correction method is capable of controlling the radiation source automatically in such a manner that the incident dose corresponds to the adjusted or selected dose value $D_R$ within the selected region ROI, irrespective of the magnitude and the configuration, the spectral deviations of the detector and the sensitivity of the dose rate measuring devices 11, 12.

What is claimed is:

1. A method for operating a radiation examination device which includes a radiation source and a detector device for the acquisition of radiation images, comprising the steps of:

measuring at least one of the imaging dose and dose rate ($R_D$) incident on a detector of the detector device, determining an image correction value ($Z_n$) for each image of a measuring sequence of successive images acquired by the detector device in dependence on a selected image region (ROI) of the detector device, and determining an adaptive correction value ($Y_{n+1}$) while using said image correction value ($Z_n$) and image correction values of any preceding images in the measuring sequence, and determining a control value ($XGC_D$, $XGC_R$) for controlling the radiation source while using at least one of the measured dose and dose rate, said step of determining a control value ($XGC_D$, $XGC_R$) comprising the step of deriving the control value ($XGC_D$, $XGC_R$) from the at least one of the measured dose and dose rate ($R_D$) while utilizing said adaptive correction value ($Y_{n+1}$).

2. A method as claimed in claim 1, further comprising the step of determining a working point ($WP_D$) of the detector device for each image acquired by the detector device from the ratio of a mean image output signal within the selected image region (ROI) to a maximum image output signal of the detector device, the image correction value ($Z_n$) being determined while utilizing said working point ($WP_D$).

3. A method as claimed in claim 2, further comprising the step of multiplying the working point ($WP_D$) determined for the relevant image by a nominal scaling factor ($SK_{NE}$) in order to form a normalized working point ($WP_{NO}$), said nominal scaling factor being formed by the quotient of a dose nominal value ($D_{NR}$) and a selected dose value ($D_R$), the image corrected value ($Z_n$) being the quotient of a nominal working point ($WP_{NE}$) and the normalized working point ($WP_{NO}$).

4. A method as claimed in claim 3, further comprising the step of scaling each acquired image by means of an image scaling factor ($SK_P$) formed by the product of the nominal scaling factor ($SK_{NE}$) and the image correction value ($Z_n$).

5. A method as claimed in claim 3, further comprising the step of determining the dose nominal value during a calibration procedure using a defined calibration radiation spectrum whereby the nominal working point for the dose nominal value is obtained automatically on the detector or within the selected image region during an exposure in conformity with the calibration spectrum.

6. A method as claimed in claim 1, wherein the step of determining the adaptive correction value ($Y_{n+1}$) comprises the step of multiplying a preceding adaptive correction value ($Y_n$) and the image correction value ($Z_n$) of the instantaneous image.

7. A method as claimed in claim 6, further comprising the step of correcting at least one of the measured dose and dose rate ($R_D$) by means of the preceding adaptive correction value ($Y_n$), the step of determining a control value further comprising the step of using at least one of the corrected dose ($D_C$and dose rate ($R_C$) to determine the control value ($XGC_D$,$XGC_R$).

8. A method as claimed in claim 1, further comprising the step of storing the image correction values from the instant image in a buffer memory for subsequent use to determine the adaptive correction value.

9. A detector device for X-ray examination, comprising:

a radiation source, a detector spaced from said radiation source whereby an object to be examined is interposed between said radiation source and said detector, a measuring device for measuring at least one of an imaging dose and dose rate ($R_D$) incident on said detector, control means for determining a control value ($XGC_D$, $XGC_R$) for controlling said radiation source while utilizing the at least one of the measured dose and dose rate ($R_D$), output means for applying the control value ($XGC_D$, $XGC_R$) to said radiation source, first determining means for determining, for each image of a measuring sequence of successive images acquired by said detector, an image correction value ($Z_n$) in dependence on a selected image region (ROI) of said detector, and second determining means for determining an adaptive correction value ($Y_{n+1}$) while utilizing said image correction value ($Z_n$) and image correction values of preceding images within the measuring sequence, said control means being arranged such that the control value ($XGC_D$, $XGC_R$) is determined from the at least one of the measured dose and dose rate ($R_D$) while using the adaptive correction value ($Y_n$).

10. A detector device as claimed in claim 9, wherein said first determining means are arranged to determine a working point ($WP_D$) of the detector device from a ratio of a mean image output signal within the selected image region (ROI) to a maximum image output signal of the detector device.

11. A detector device as claimed in claim 8, further comprising generating means for generating a nominal scaling factor ($SK_{NE}$) which is formed by the quotient of a dose nominal value ($D_{NE}$) and a selected dose value ($D_R$), and said first determining means including a multiplier which multiplies the working point ($WP_D$) determined for the relevant image by the nominal scaling factor ($SK_{NE}$) to obtain a normalized working point $WP_{NO}$, and a dividing device which forms the quotient of a nominal working point ($WP_{NE}$) and the normalized working point ($WP_{NO}$) to obtain the image correction value ($Z_n$).

12. A detector device as claimed in claim 11, further comprising scaling means for scaling the relevant acquired image by means of an image scaling factor ($SK_p$) formed as the product of the nominal scaling factor ($SK_{NE}$) and the image correction value ($Z_n$).

13. A detector device as claimed in claim 9, wherein said second determining means includes a correction value buffer memory and is arranged such that the adaptive correction value ($Y_{n+1}$) for a next image is formed, using a recursive method, each time as the product of the preceding adaptive correction value ($Y_n$) and the image correction value ($Z_n$) of the instantaneous image.

14. A detector device as claimed in claim 9, wherein said control means are arranged to correct the at least one of the measured dose and dose rate ($R_D$) by means of the adaptive correction value ($Y_n$) to determine the control value ($XGC_D$, $XGC_R$).

15. An arrangement for controlling a radiation source of a detector device for X-ray examination, comprising:

a detector spaced from said radiation source whereby an object to be examined is interposed between the radiation source and said detector, a measuring device for measuring at least one of an imaging dose and dose rate ($R_D$) incident on said detector, control means for determining a control value ($XG_D$, $XGC_R$) for controlling the radiation source while utilizing the at least one of the measured dose and dose rate ($R_D$), first determining means for determining, for each image of a measuring sequence of successive images acquired by said detector, an image correction value ($Z_n$) depending on a selected image region (ROI) of said detector, and second determining means for determining an adaptive correction value ($Y_{n+1}$) while utilizing said image correction value ($Z_n$) and image correction values of preceding images within the measuring sequence, said control means being arranged such that the control value ($XGC_D$, $XGC_R$) is determined from the at least one of the measured dose and dose rate ($R_D$) while using the adaptive correction value ($Y_n$).

16. An arrangement as claimed in claim 15, wherein said first determining means are arranged to determine a working point ($WP_D$) of the detector device from a ratio of a mean image output signal within the selected image region (ROI) to a maximum image output signal of the detector device.

17. An arrangement as claimed in claim 16, further comprising generating means for generating a nominal scaling factor ($SK_{NE}$) which is formed by the quotient of a dose nominal value ($D_{NE}$) and a selected does value ($D_R$), and said first determining means including a multiplier which multiplies the working point ($WP_D$) determined for the relevant image by the nominal scaling factor ($SK_{NE}$)to obtain a normalized working point ($WP_{NO}$), and a dividing device which forms the quotient of a nominal working point ($WP_{NE}$) and the normalized working point ($WP_{NO}$) to obtain the image correction value ($Z_n$).

18. An arrangement as claimed in claim 17, further comprising scaling means for scaling the relevant acquired image by means of an image scaling factor ($SK_D$) formed as the product of the nominal scaling factor ($SK_{NE}$) and the image correction value ($Z_n$).

19. An arrangement as claimed in claim 15, wherein said second determining means include a correction value buffer memory and is arranged such that the adaptive correction value ($Y_{n+1}$) for a next image is formed each time as the product of the preceding adaptive correction value ($Y_n$) and the image correction value ($Z_n$) of the instantaneous image.

20. An arrangement device as claimed in claim 15, wherein said control means are arranged to correct the at least one of the measured dose and dose rate ($R_D$) by means of the adaptive correction value ($Y_n$) to determine the control value ($XGC_D$, $XGC_R$).

* * * * *

UNITED STATES PATENT AND TRADEMARK OFFICE

CERTIFICATE OF CORRECTION

PATENT NO. : 6,430,258 B1
DATED : August 6, 2002
INVENTOR(S) : Willem E. Spaak

It is certified that error appears in the above-identified patent and that said Letters Patent is hereby corrected as shown below:

Drawings,
Figure 1, change formula in the box "$Y_n+1 = Y_n + Z_n$" to -- $Y_n+1 = Y_n \times Z_n$ --.

Column 5,
Line 48, change "$Z_z$" to -- $Z_N$ --.

Signed and Sealed this

Twenty-ninth Day of April, 2003

JAMES E. ROGAN
*Director of the United States Patent and Trademark Office*